US009681720B2

(12) United States Patent
Davis

(10) Patent No.: US 9,681,720 B2
(45) **Date of Patent: *Jun. 20, 2017**

(54) SINGLE-PIECE CUFFED JEWELRY SLEEVE AND DISPLAY BOARD SET: DISPLAY-TRAVEL-STORAGE ALL-IN-ONE PROTECTIVE SET

(71) Applicant: Shirley Mae Davis, Dayton, OH (US)

(72) Inventor: Shirley Mae Davis, Dayton, OH (US)

( * ) Notice: Subject to any disclaimer, the term of this patent is extended or adjusted under 35 U.S.C. 154(b) by 907 days.

This patent is subject to a terminal disclaimer.

(21) Appl. No.: 13/998,060

(22) Filed: Sep. 28, 2013

(65) Prior Publication Data

US 2015/0090612 A1 Apr. 2, 2015
US 2016/0360844 A9 Dec. 15, 2016

Related U.S. Application Data

(63) Continuation-in-part of application No. 29/442,757, filed on May 7, 2013, now Pat. No. Des. 728,936.
(Continued)

(51) Int. Cl.
*A45C 11/16* (2006.01)
*A45C 13/30* (2006.01)
(Continued)

(52) U.S. Cl.
CPC ..... *A45C 11/16* (2013.01); *A45C 11/00* (2013.01); *A45C 13/002* (2013.01); *A45C 13/02* (2013.01); *A45C 13/30* (2013.01); *A45C 13/42* (2013.01); *A45C 15/00* (2013.01); *A45C 2013/026* (2013.01); *A45C 2200/05* (2013.01); *A45C 2200/15* (2013.01)

(58) Field of Classification Search
CPC ..... A45C 13/00; A45C 13/002; A45C 13/10; A45C 13/30; A45C 13/02; A45C 13/42; A45C 11/16; A45C 2200/15; A45C 2013/026; A45C 15/00; A45C 2013/303; A45C 2013/306; A45C 11/04
USPC ..... 220/23.86; 206/6.1
See application file for complete search history.

(56) References Cited

U.S. PATENT DOCUMENTS 4,401,219 A 8/1983 Mink
4,735,246 A * 4/1988 Niehaus ..... A45C 7/0095 206/479

(Continued)

*Primary Examiner* — Andrew Perreault

(57) ABSTRACT

This invention is a Revolutionary protective Cuffed Jewelry Sleeve and Jewelry Display Board set for storing and protecting each individual pieces of jewelry stored within group storage of multiple items. Revolutionizing existing group storage solutions and adaptable to new and creative storage containers and hanging mechanism with effective protection and permanent organization of multiple pieces of jewelry stored together including eliminating damaging tangling, bunching and/or folding from use of under-sized jewelry boxes and drop-in bags and pouches commonly used for single-piece jewelry storage. Each individual piece of jewelry is secured in place to a Display Board with its style and length displayed and inserted inside its protective and securely cuff-capped Jewelry sleeve with a visible identification cuff displaying the jewelry identification and/or photo image for selection without visibility while simultaneously protecting and storing each individual stored-ready for display and packed-ready for travel.

19 Claims, 18 Drawing Sheets

Related U.S. Application Data

Figure 1:
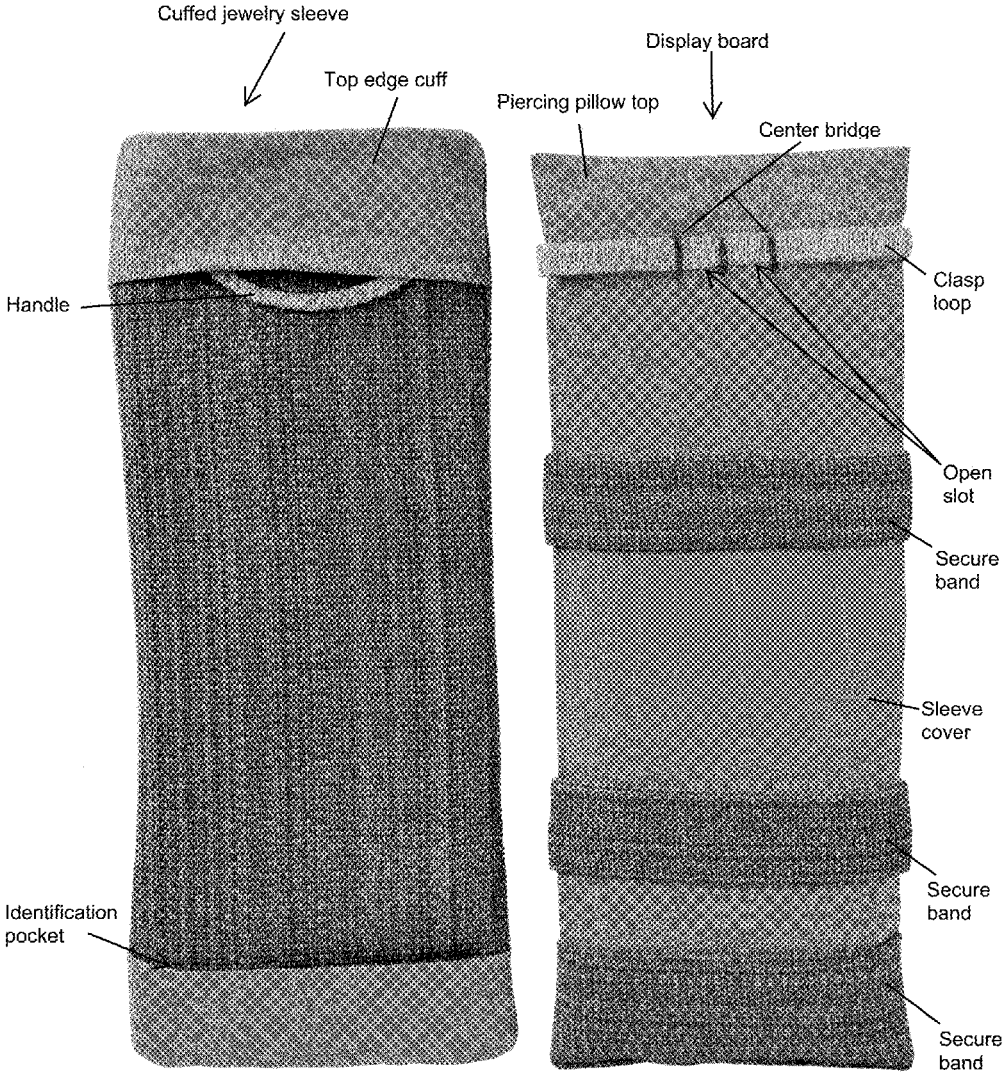

(60) Provisional application No. 61/744,700, filed on Oct. 2, 2012.

(51) Int. Cl.

| | |
|---|---|
| ***A45C 13/10*** | (2006.01) |
| ***A45C 13/00*** | (2006.01) |
| ***A45C 13/02*** | (2006.01) |
| ***A45C 13/42*** | (2006.01) |
| ***A45C 11/00*** | (2006.01) |
| ***A45C 15/00*** | (2006.01) |

(56) References Cited

U.S. PATENT DOCUMENTS 4,760,920 A * 8/1988 Thomsen ..... A45C 11/16 150/131
5,121,833 A * 6/1992 Lindsay ..... A45C 7/0095 206/18
5,246,103 A * 9/1993 Hicks ..... A45C 11/16 206/495
5,490,619 A * 2/1996 Boyar ..... A45F 3/02 150/103
5,617,948 A * 4/1997 Rainey ..... A45C 11/16 206/5
D458,752 S 6/2002 Wolf
D471,011 S 3/2003 Kowalsky
D473,715 S 4/2003 Moldovan
6,634,041 B2 * 10/2003 Higashi ..... A45C 3/10 383/4
D621,780 S 8/2010 Ferber et al.
D646,485 S 10/2011 Mason
8,312,990 B2 * 11/2012 Gaspari ..... A45C 11/26 206/566
8,590,698 B1 * 11/2013 Osborne ..... A45C 11/04 206/38
8,627,950 B2 * 1/2014 Bland ..... A45C 7/0077 206/495
2007/0151871 A1 * 7/2007 Brawley ..... A45C 11/24 206/37
2007/0158380 A1 * 7/2007 Calkin ..... A41D 13/0012 224/675
2015/0335140 A1 * 11/2015 Cole ..... A45F 5/02 24/3.7

* cited by examiner

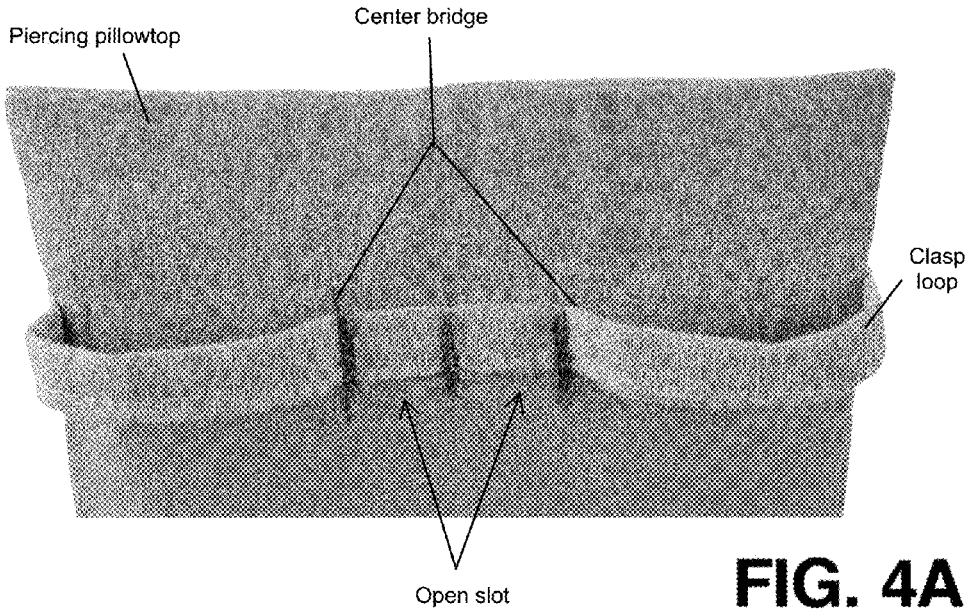
FIG. 4A
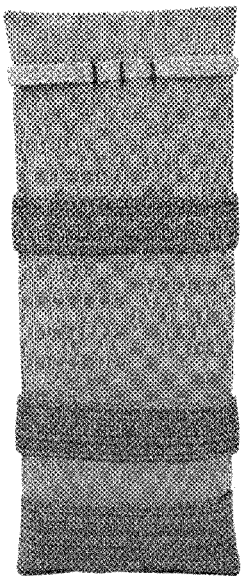

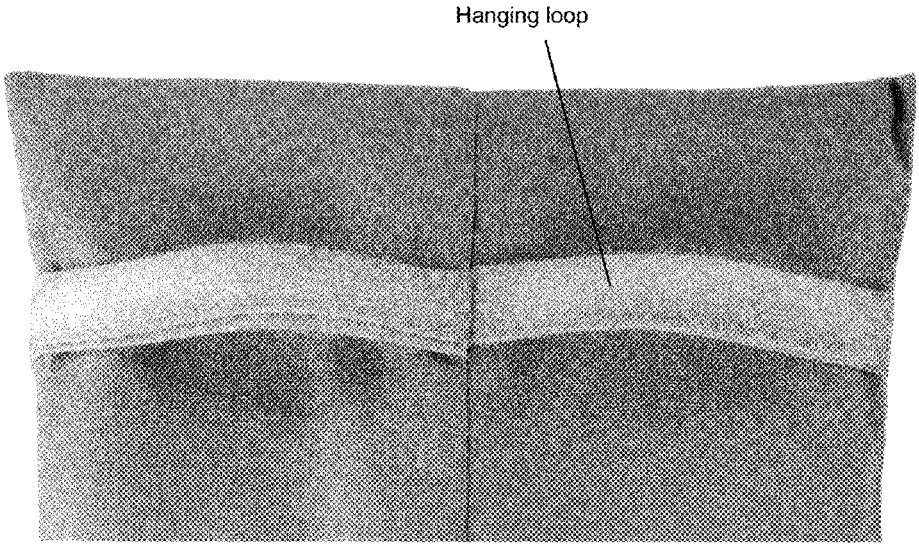
FIG. 4D
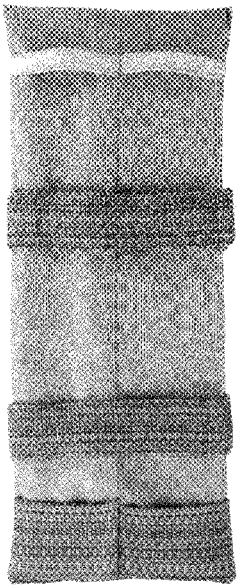

SINGLE-PIECE CUFFED JEWELRY SLEEVE AND DISPLAY BOARD SET: DISPLAY-TRAVEL-STORAGE ALL-IN-ONE PROTECTIVE SET

CROSS-REFERENCE TO RELATED APPLICATIONS

This application is a continuation-in-part of U.S. Design patent application Ser. No. 29/442,757, filed May 7, 2013, and this application also claims the benefit of priority under 35 U.S.C. §119(e) to U.S. Provisional Application Ser. No. 61/744,700, filed Oct. 2, 2012.

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

Jewelry is one of the most coveted investment and fashion accessory. Protective packaging for individual pieces of jewelry stored alone or within a group storage is the subject matter of this invention. This single-piece jewelry invention is a three function protective packaging system, which package each piece of jewelry for display, storage and travel with all functions interchangeable. This invention is for all styles, sizes and classifications of jewelry for the home and retail consumers. Each individual pieces of jewelry, within the storage of multiple pieces of jewelry, is securely packed for unexposed protection with ease of identification without visibility. This invention keeps each single-piece of jewelry protected and secured in storage with simultaneous and interchangeable functions of display-ready for personal fashion coordination or retail sales and packed-ready for personal travel or mobile retail sales travel.

The all-in-one features of this invention can revolutionize existing jewelry storage containers and/or solutions, updating each to become more efficient rather than obsolete. The features are interchangeable in eliminating the need to fold or bunch over-sized jewelry to fit limited-sized single-piece jewelry boxes and eliminates damage from tangling and/or bunching of loose jewelry dropped or placed in inefficient and/or obsolete single-piece jewelry storage containers. This invention effectively eliminates the repeated clutter, dishevel and/or damaging environments resulting from grouping multiple pieces of exposed jewelry side-by-side or layered in storage containers, furniture, shelving units, from hanging mechanisms and/or any combination of fixed jewelry storage and display products for storing multiple pieces of exposed jewelry together. 'Cluttered-visions' of exposed jewelry stored together are eliminated with this invention and effortless selection of specific jewelry from within a grouped storage is without hindrance with this invention.

Transporting prior arts' pre-filled multiple jewelry storage and display mobile containers for travel has a limiting advantage only when travel requires all the stored jewelry. Otherwise, additional efforts are required to select and remove jewelry not needed for travel, creating the need for a temporary storage requiring reorganizing, reattaching and/or replacing the jewelry temporarily removed from the mobile storage container when travel is completed. This revolutionary single-piece jewelry packaging invention eliminates the need to handle or displace stored jewelry not needed or selected for travel or any other use. With this single-piece packaging invention, each specific piece of jewelry needed from storage is easily identifiable, selected and simply returned to permanent storage in its individual protective cuffed sleeve and display board set after each use and/or completed travel without handling, displacing or reorganizing any of the stored jewelry not needed for use. This invention is designed with complete simplicity for the modern and post 911 consumer. All parts are permanently attached allowing this invention to function without any additional effort to attach or detach parts to perform the travel, storage or display functions.

Prior art U.S. Pat. No. 4,735,246 and U.S. Pat. No. 5,246,103 are for storage, display and travel of exposed multiple pieces of jewelry with fixed and/or limiting dimensions not conducive for consumers customization of unique requirements for style, size and classification of jewelry storage. Both prior art multiple-jewelry storage 'display feature' is limited to a visual obstructed display viewing among the stored jewelry hanging adjacent in a straight-line side-by-side which limits the displays because straight-line hanging cannot display jewelry shape or style. Exposing jewelry surfaces directly to metal or other hard surface hooks create potential abrasion damage from rubbing or other movement. This revolutionized invention display the jewelry from two non-damaging fabric or other soft material clasp loops with a center bridge separating the sides of the jewelry, displaying the jewelry style and shape. The prior art applications of the multiple pieces of jewelry storage constantly expose and subject all stored jewelry to damage from adjacent hanging jewelry when handling the jewelry in search of specific selections. Both prior art display features also subject every piece of jewelry to abrasive accumulation of dust; and sterling silver jewelry to tarnishing from constant air exposure each time the protective covering is removed to access one or more pieces of the stored jewelry. Stored jewelry not needed is subjected to unnecessary handling and dishevel without purpose as with lose jewelry storage in fixed containers. Both prior art applications target home consumers' of Fashion Jewelry. Multi-pieces of jewelry stored closely, touching or likelihood to touch is not ideal or generally acceptable for storing fine or sentimental jewelry. This single piece invention all-inclusive design and functions for individual pieces of jewelry is perfect for all jewelry classifications: Antique, Fashion, Fine and Sentimental Jewelry. This invention target markets include the home consumer, mobile jewelry salesperson, retailers of fashion and fine jewelry.

BRIEF SUMMARY OF THE INVENTION

This invention is an ultimate protective jewelry storage set for protecting individual pieces of jewelry within grouped storage of multiple pieces of jewelry and/or other objects. The set consist of a padded and rigid Jewelry Display Board and a protective Cuffed Jewelry Sleeve designed to revolutionize various existing jewelry storage cabinets, containers, furniture, hanging mechanism and/or other creative storage solutions by storing each piece of jewelry individually packed and protected for display and/or travel at all times.

The Jewelry Display Board stores single pieces of jewelry of any size and style by using the board's appropriate and permanently attached optional features: The Jewelry Clasp Loops with a Center Bridge for separating the jewelry sides, a Jewelry Piercing Surface for attaching jewelry with posts and/or pins, two Open Slots for hanging earrings with ear wire and a number of equally spaced secure bands or ribbon ties to secure the jewelry from movement in storage. The jewelry is secured to the board with its style and length fully displayed and inserted into the protective cuffed jewelry sleeve, concealing and storing the jewelry for quick access and instant display viewing at all times.

The Cuffed Jewelry Sleeve has protective padding and two attached exterior cuffs. The top upper edge cuff flips over the sleeve opening securely enclosing the Display Board inside the Sleeve. The lower front edge attached cuff displays a visible identification card or photo of the enclosed jewelry for easy identification without visibility. The Cuffed Sleeve and Display Board together create a sandwich effect of padded protection of each piece of jewelry in storage.

BRIEF DESCRIPTION OF THE SEVERAL VIEWS OF THE PHOTOGRAPHS

FIG. 1: Single-Piece Cuffed Jewelry Sleeve and Display Board Set.

Figure 2:
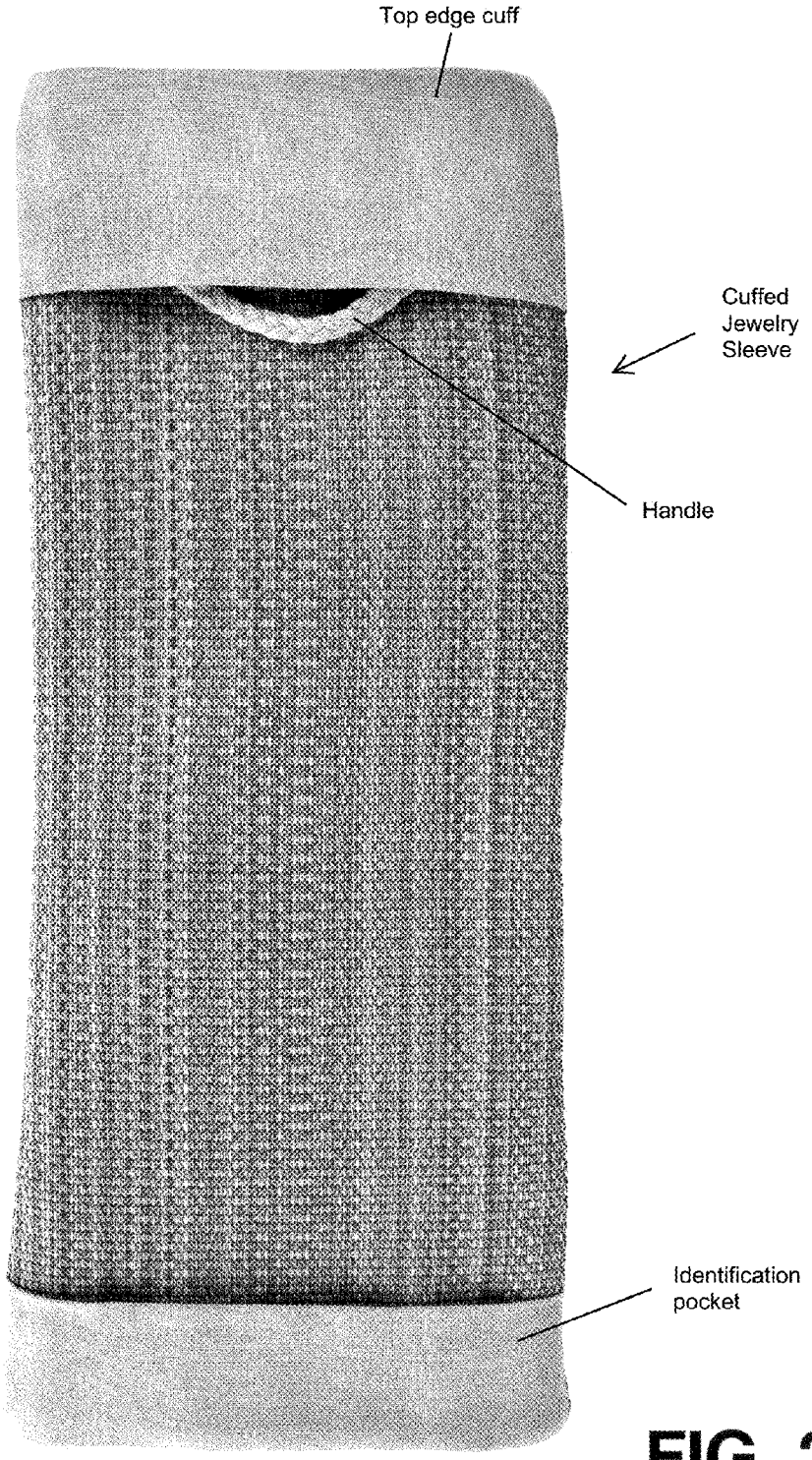

FIG. 2: View of the Cuff Sleeve front side with top and bottom cuffs attached; cuff Shown at top of sleeve conceals the handle and flip over to close the Sleeve opening; Cuff shown at bottom of sleeve holds and display identification.

Figure 2A:
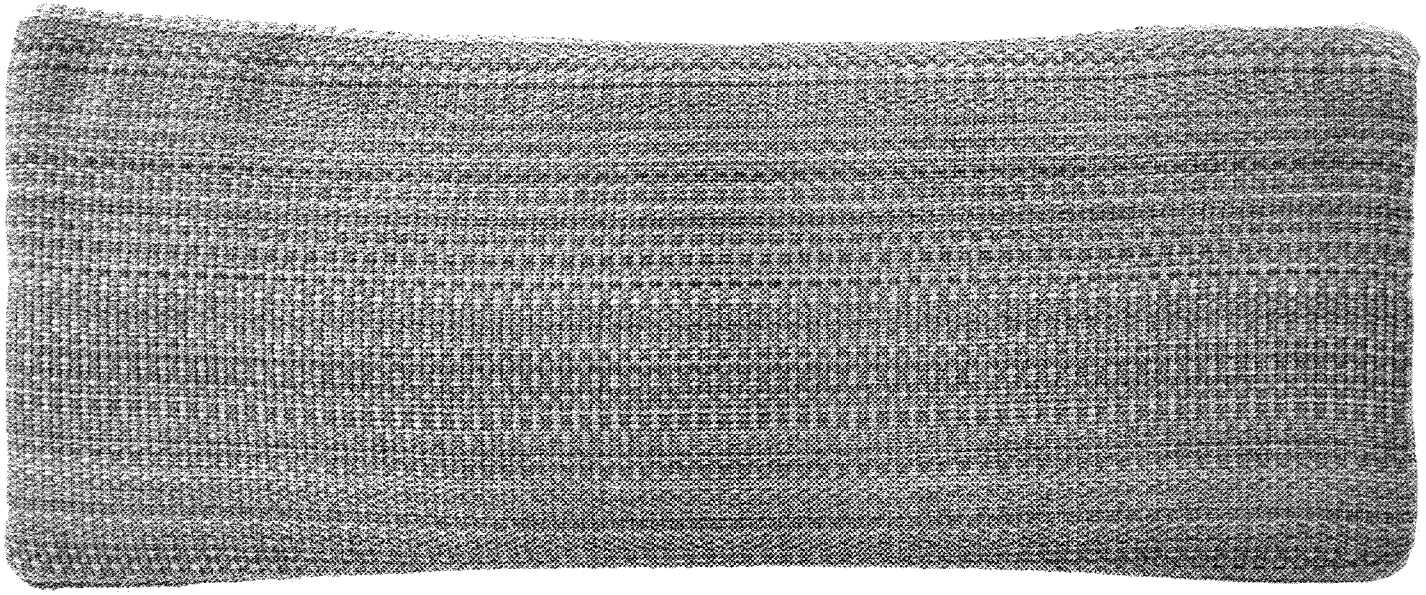

FIG. 2A: View of the open sleeve backside.

Figure 3:
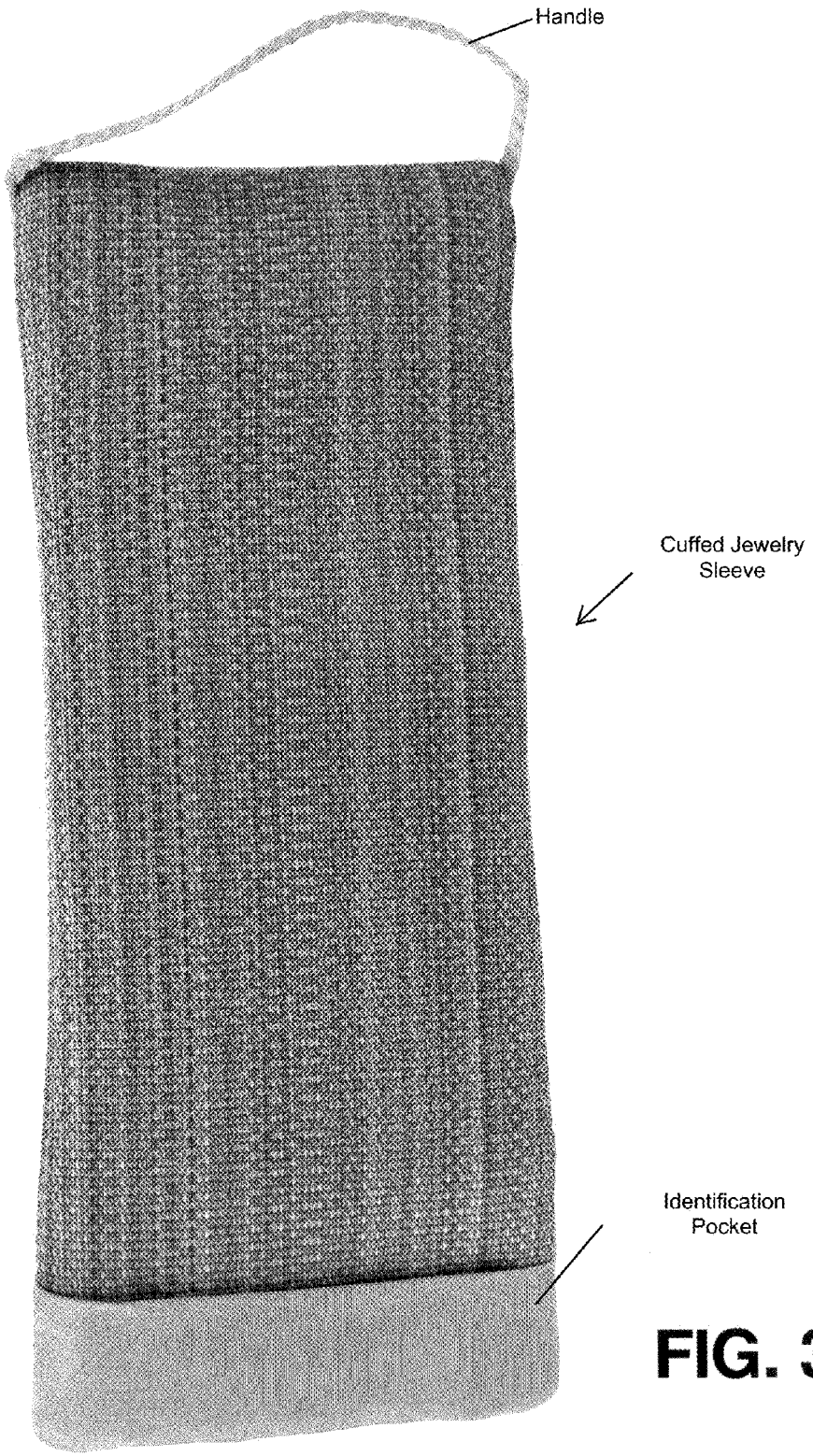

FIG. 3: Front side view of a closed flipped-cuff sleeve. Top-cuff flipped to sleeve backside to close sleeve opening. Bottom cuff holds identification on front-side of sleeve.

Figure 3A:
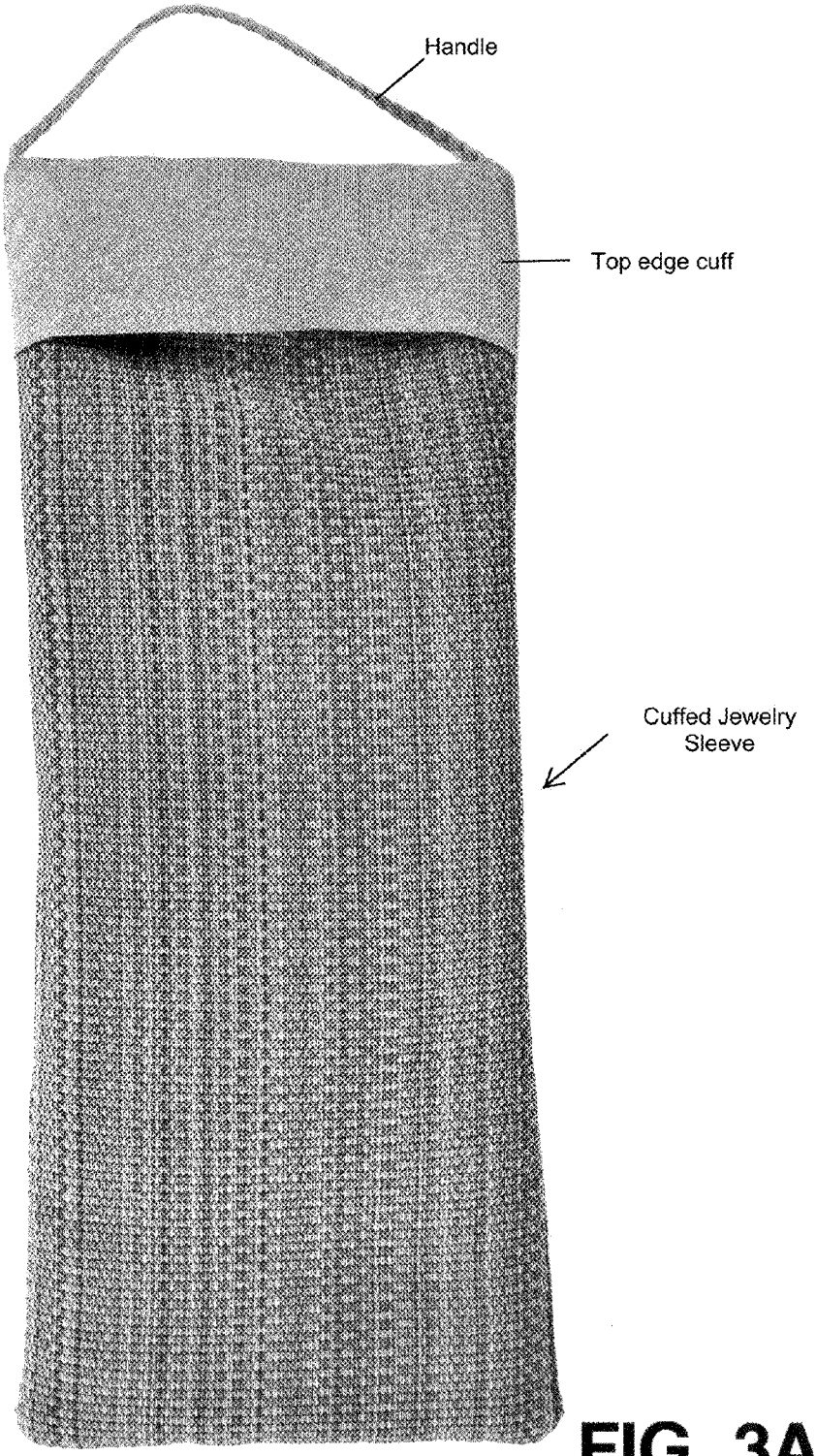

FIG. 3A: Backside view with top cuff of the close sleeve after the top cuff is flipped to the backside.

Figure 3B:
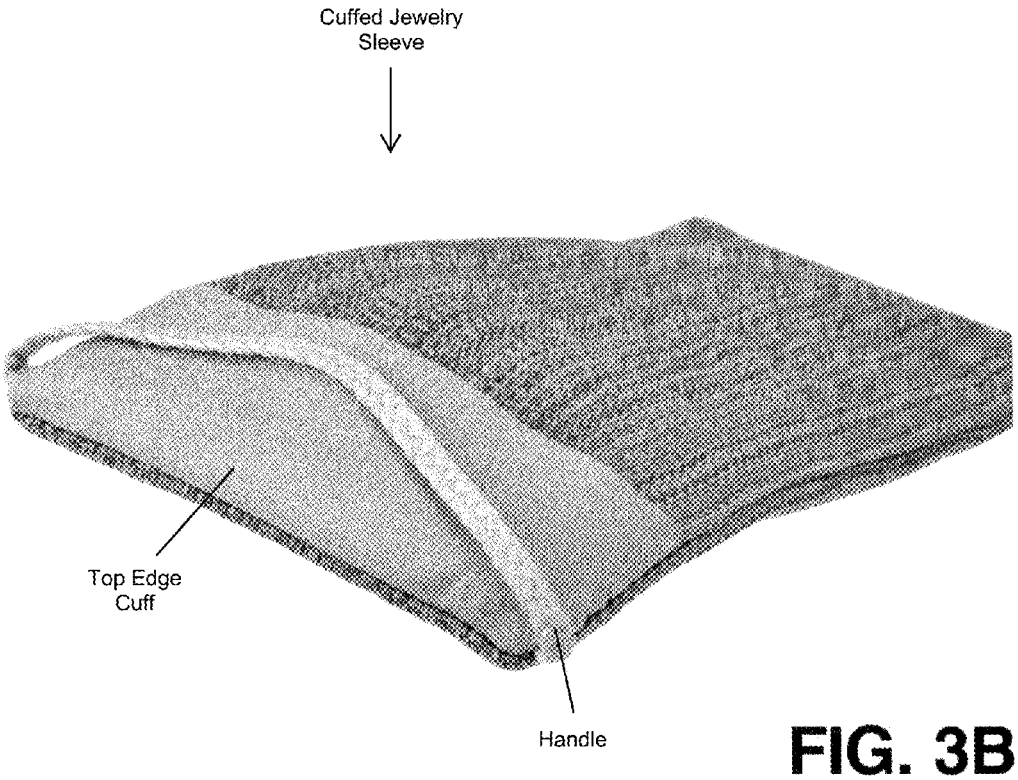

FIG. 3B: Exploded front-side view of the secure cuff closure, showing the handle revealed with the cuff flipped from front to back.

Figure 4:
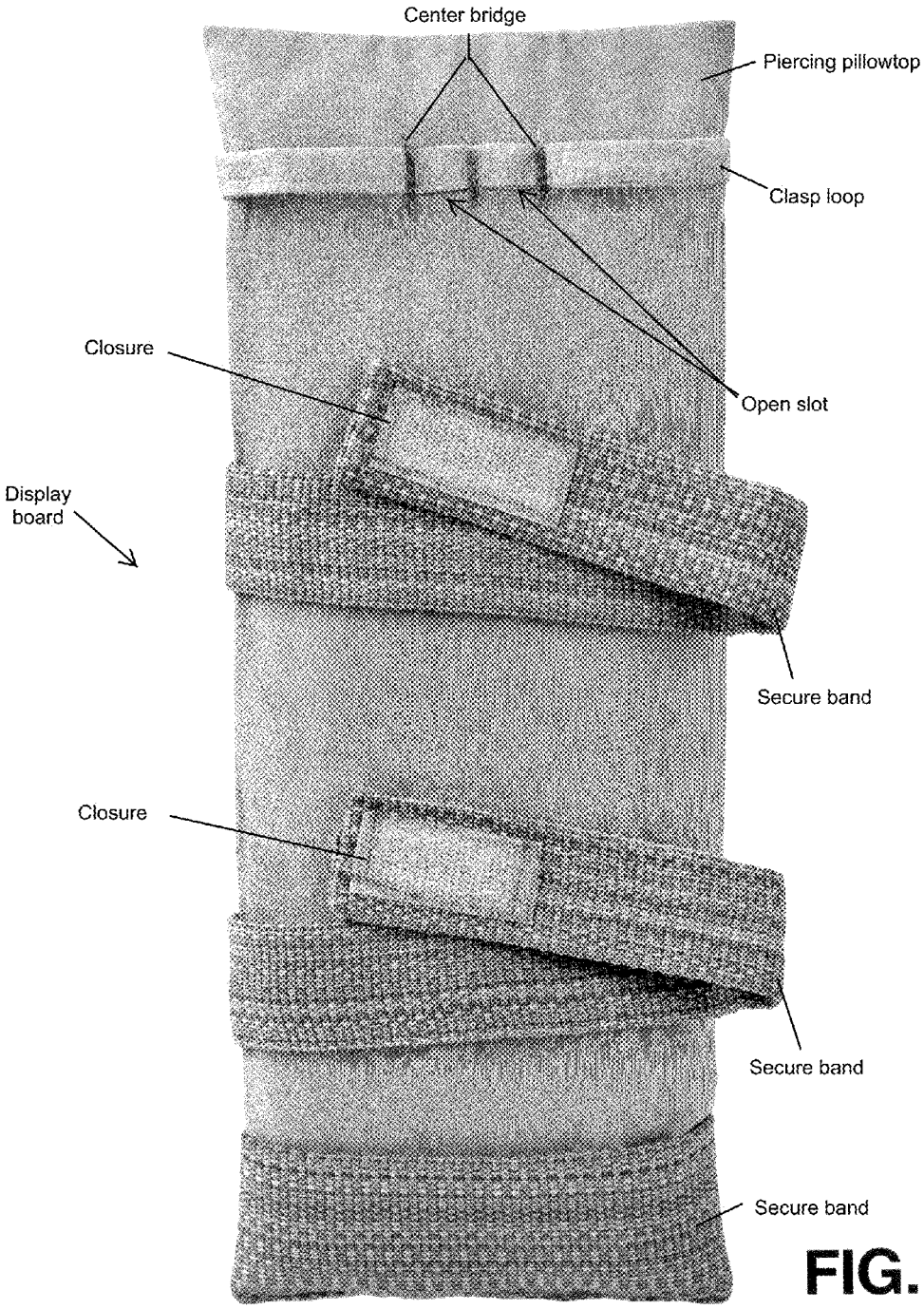

FIG. 4: Front side of Display Board with three secure bands attached at center back. Lower edge secure band stitched in place. Top of Display Board is a piercing surface for attaching jewelry. Below the piercing surface is two clasp Loops divided by a Center Bridge.

FIG. 4A: Exploded view of the Display Board Piercing Surface at top of the Display Board and view of the two Clasp Loops. The three lines of stitches between the clasp loops form the Center Bridge and slots for hanging earrings.

Figure 4B:
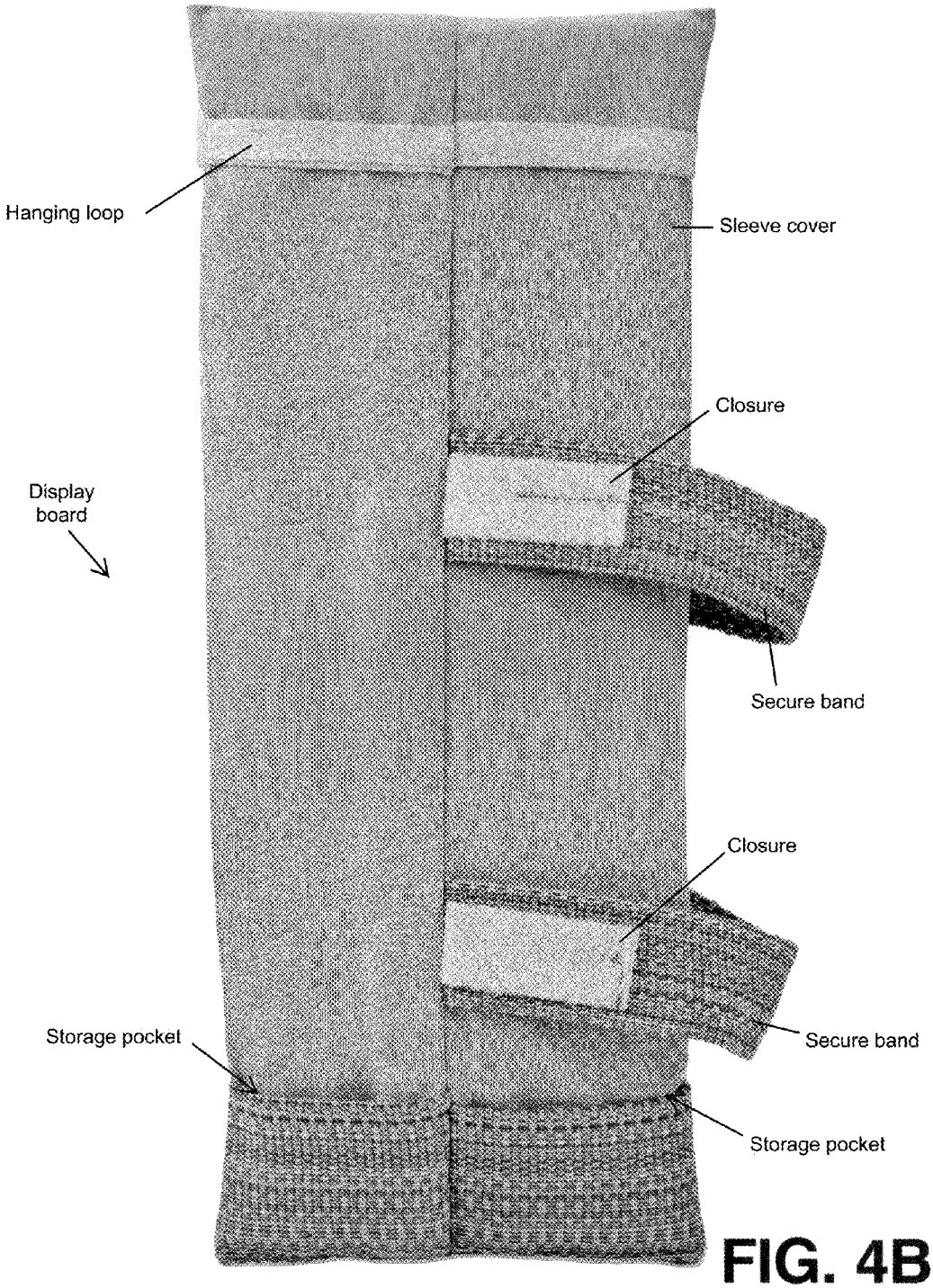

FIG. 4B: Backside view of the Display Board features: Two hanging loops at top of board. View of Secure Bands attached at center back. Two miscellaneous information pockets at bottom edge of Display board divided by center-back seam.

Figure 4C:
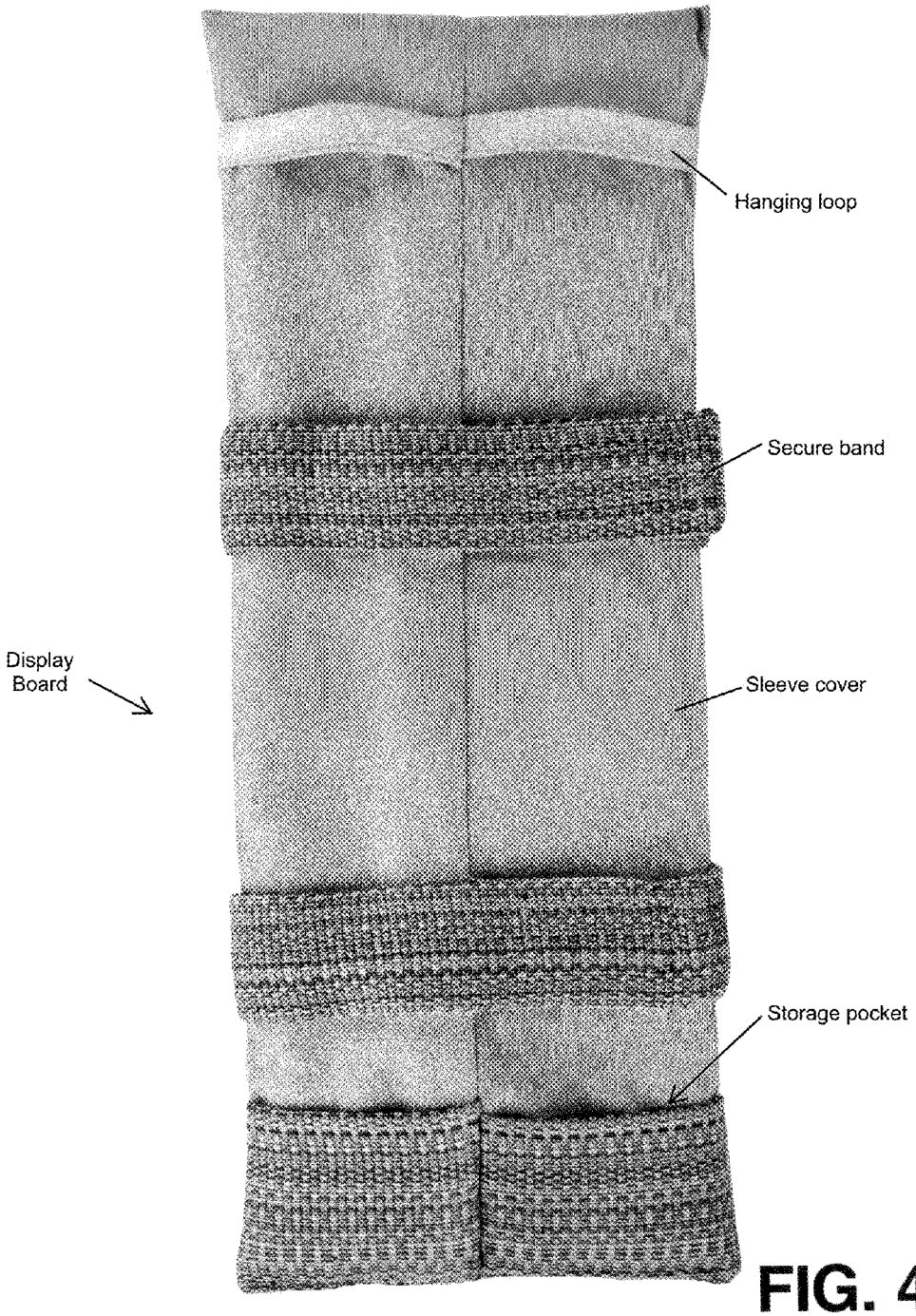

FIG. 4C: Backside view of secured Display Board. Secure bands are secured around jewelry and Display Board to backside with Velcro.

FIG. 4D: View of the Display Board optional hanging loop two inches below the top edge of the Display Board on the backside.

Figure 5:
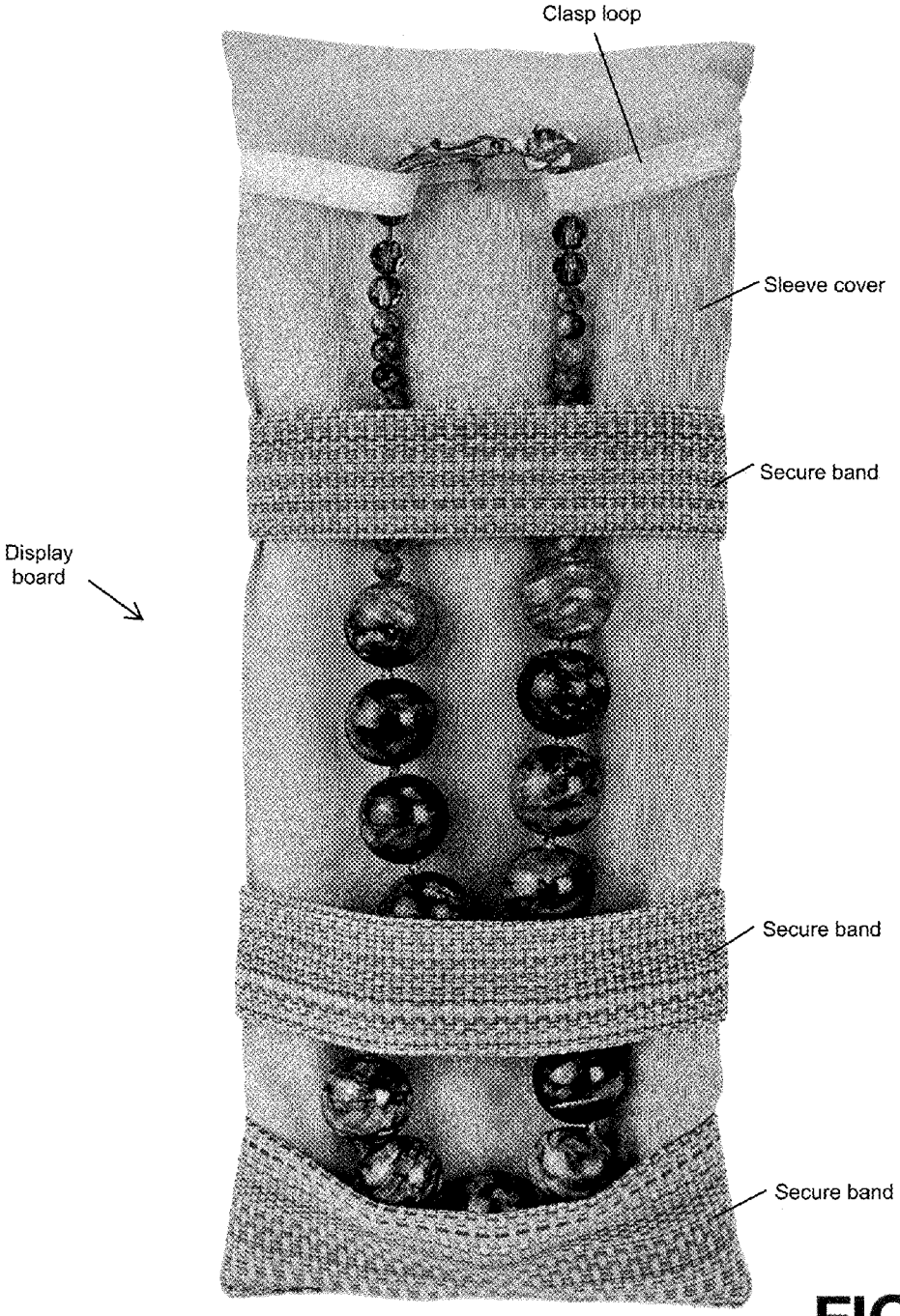

FIG. 5: View of Jewelry secured to Display Board with two wrap-around secure bands and showing the end of necklace secured in the lower edge stitched in-place, 'pocket-like', secure band.

Figure 6:
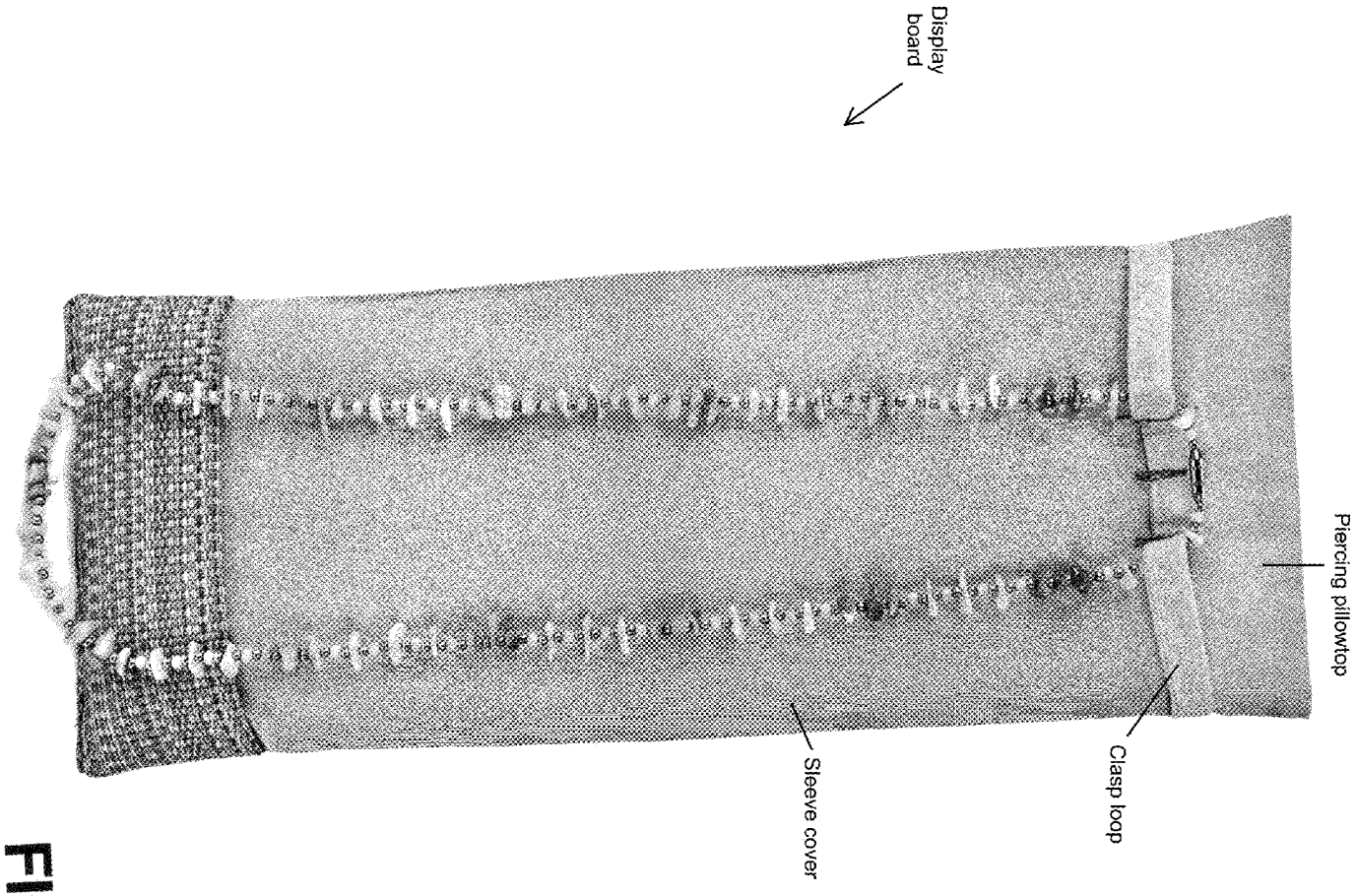

FIG. 6: Jewelry displayed hanging from the Display Board Clasp Loops for 'show', optional display viewing with secure bands folded to the Display Board backside.

Figure 7:
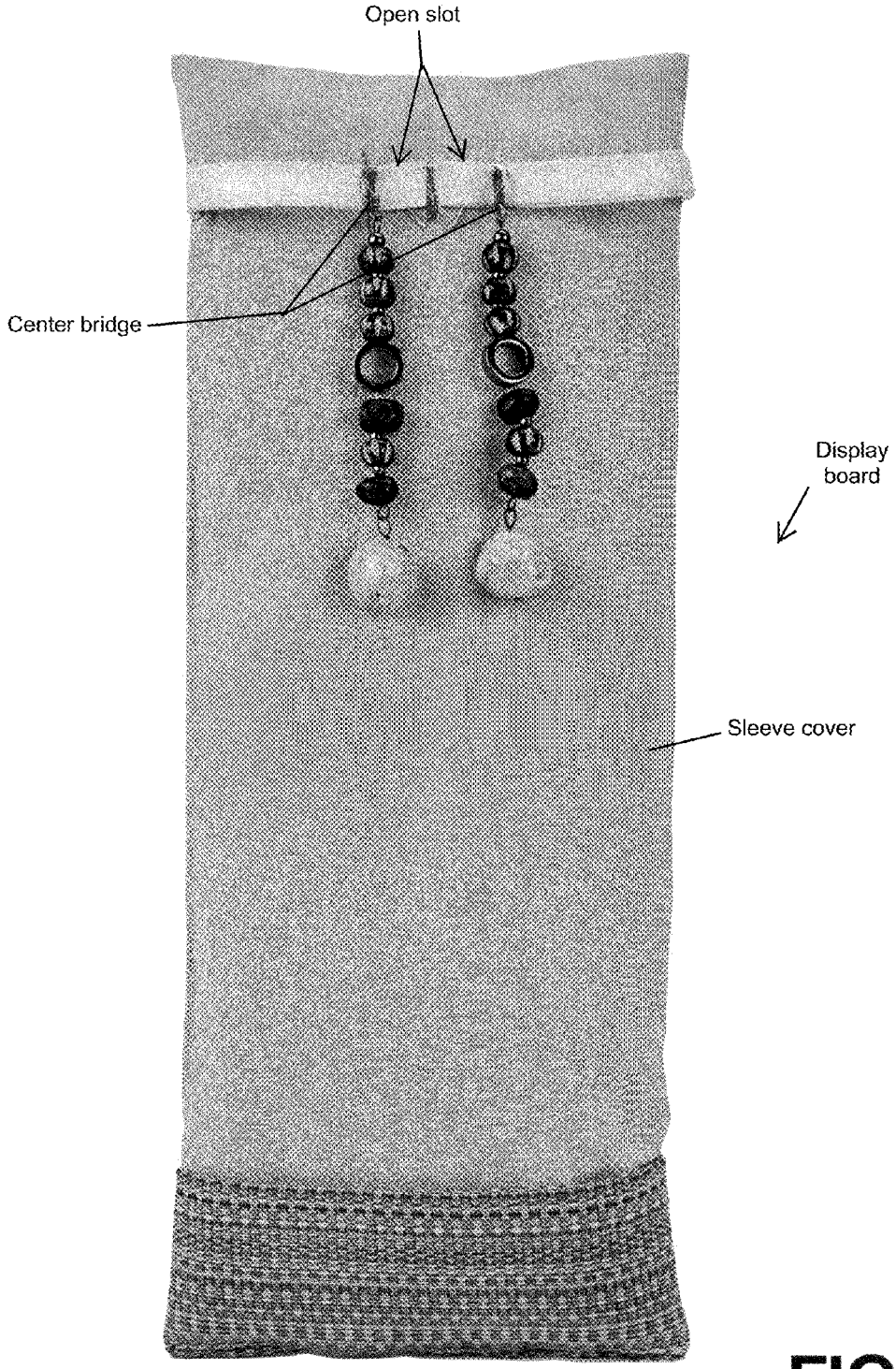

FIG. 7: View of the application of the Earrings Slots within the Clasp Loops Center Bridge. Earrings hung securely by inserting the ear wire into the two slots.

Figure 8:
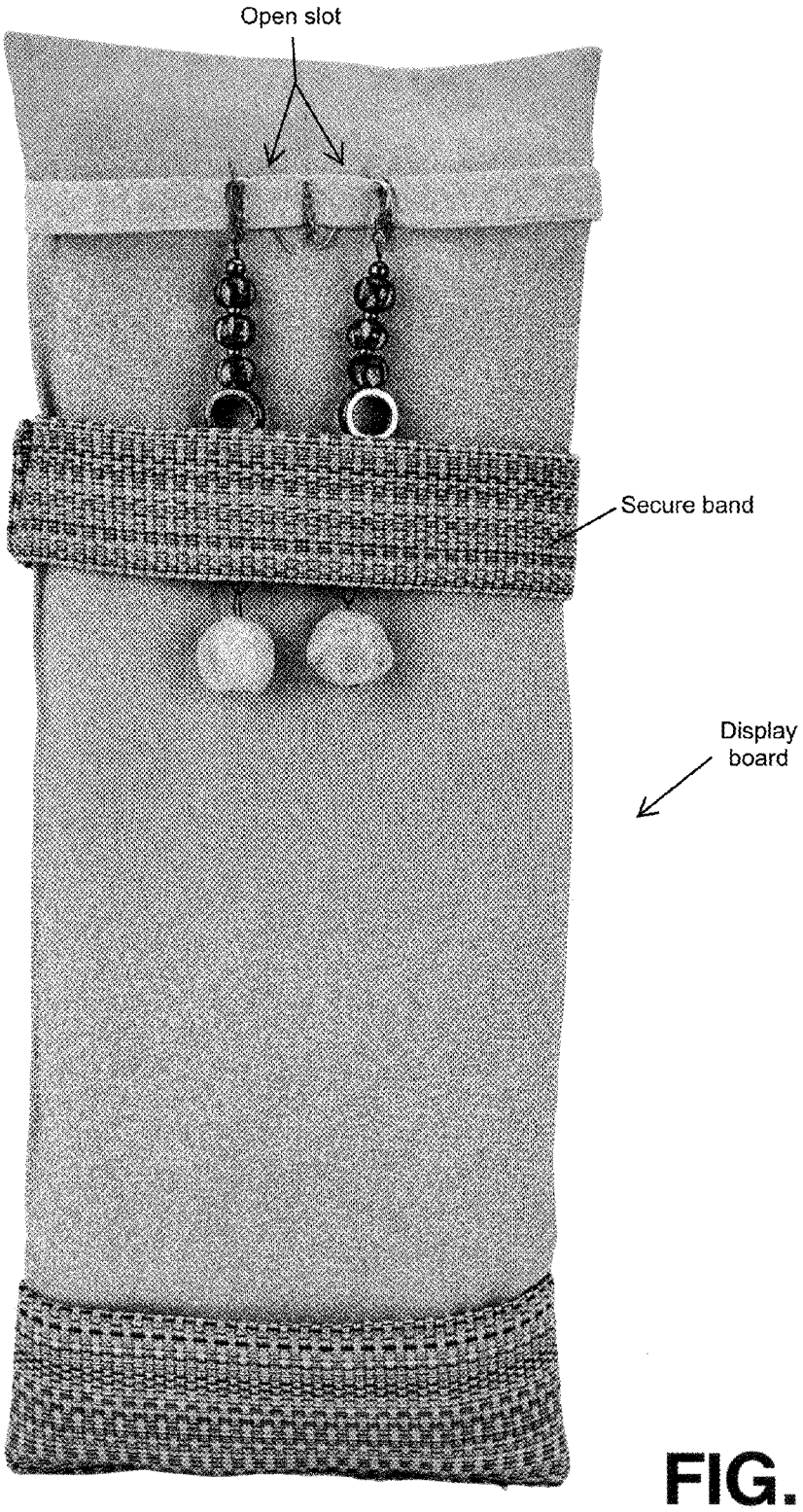

FIG. 8: View of Earrings secured to an appropriate length Display Board and secured with a secure band.

Figure 9:
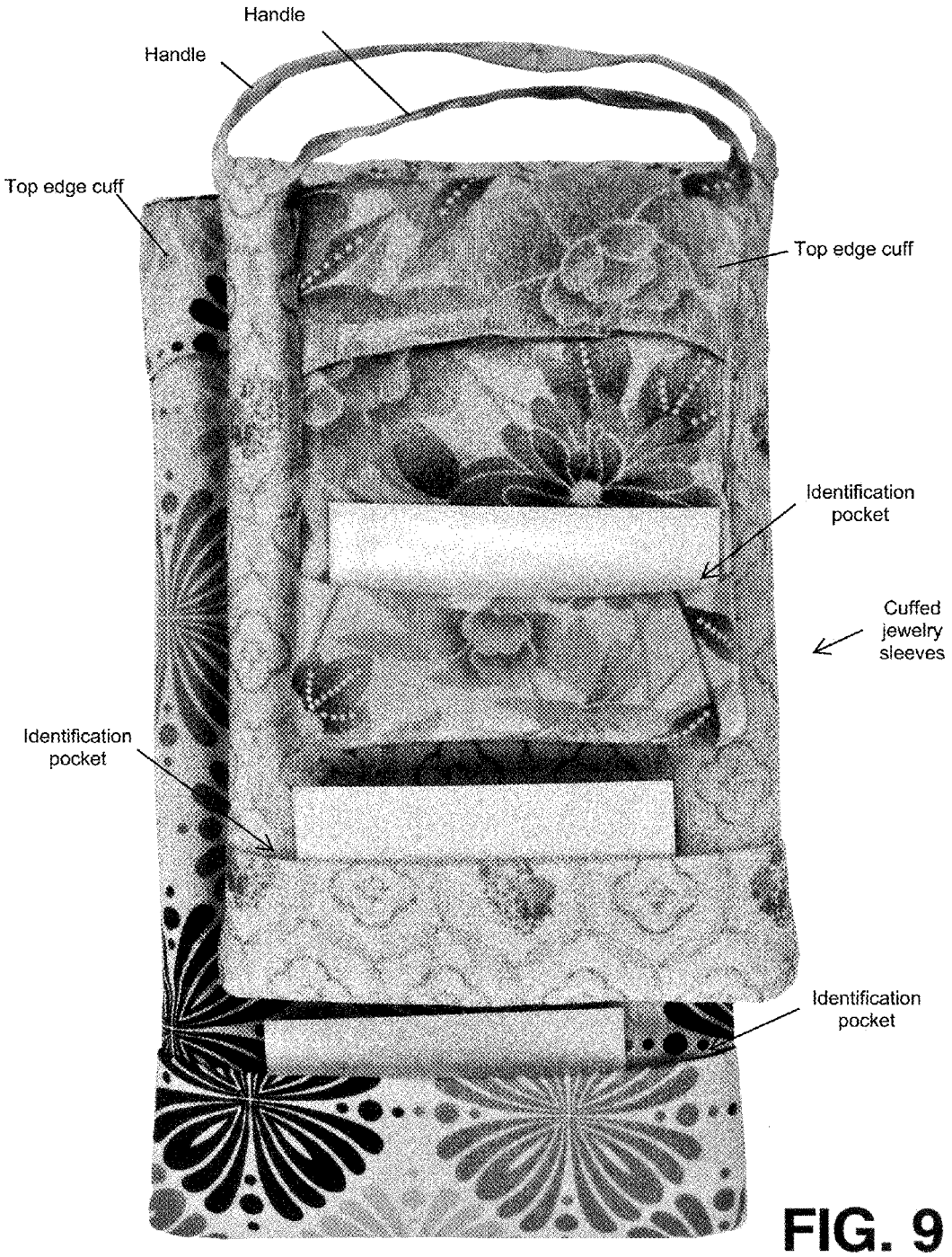
Figure 10:
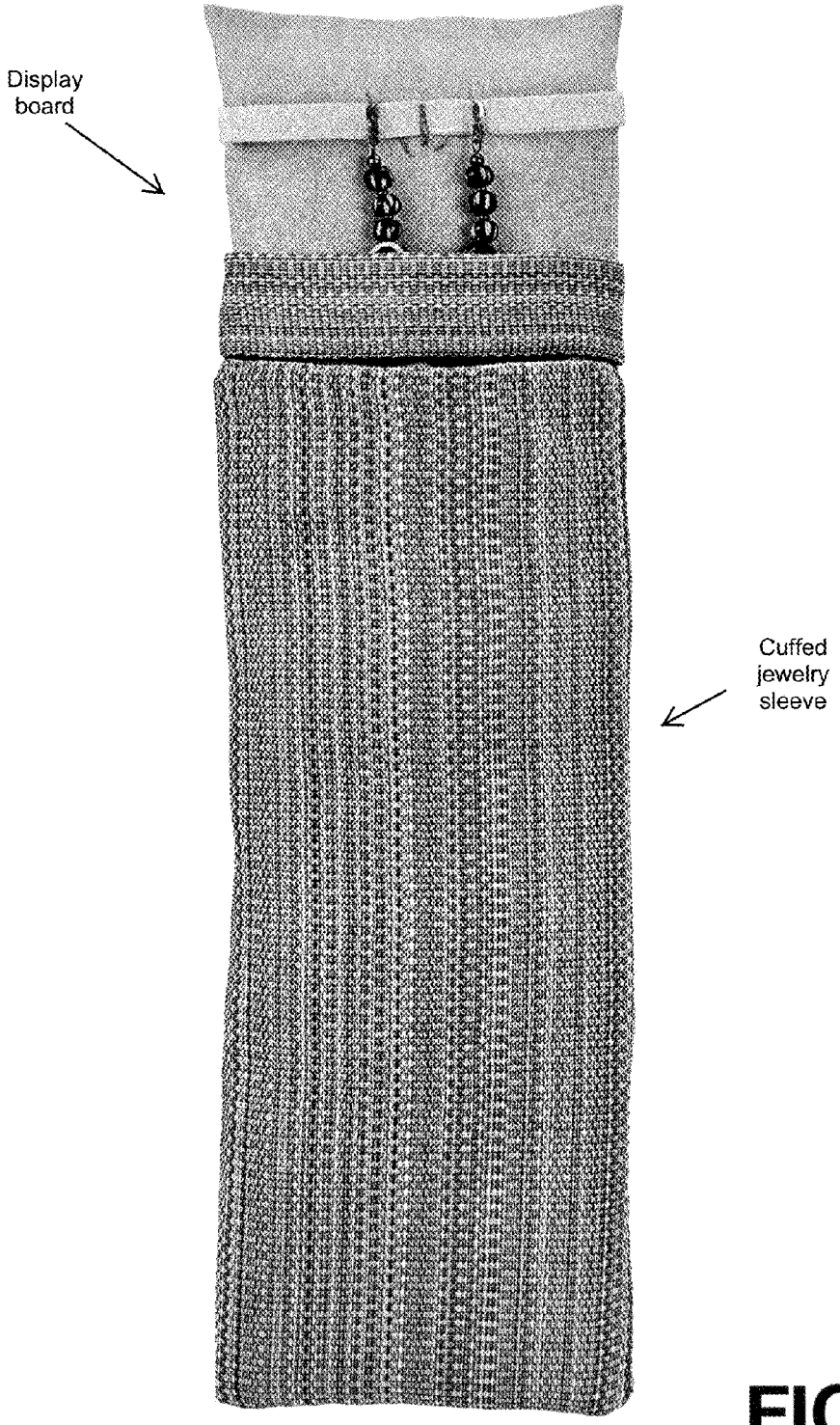

FIG. 9: View showing visibility of jewelry identification card in the lower front edge cuff when sleeves are stacked in a two or more inch sequence of lengths FIG. 10: Demonstrated views showing applications of this invention.

Figure 11:
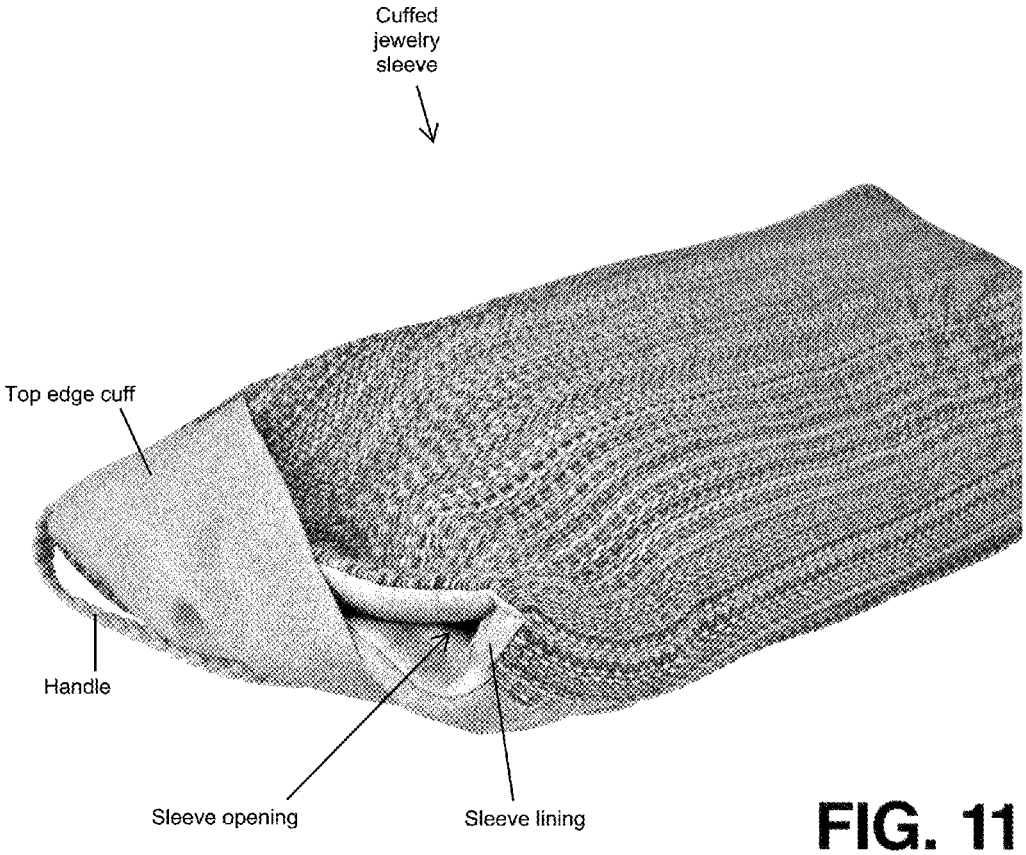

FIG. 11: Exploded view of top edge cuff flipping over the sleeve opening for a secure cap close after inserting the Display Board with jewelry and revealing the sleeve handle.

DETAILED DESCRIPTION OF THE INVENTION

This invention, a Single-Piece Cuffed Jewelry Sleeve and Display Board Set: Display-Travel-Storage All-In-One Protective Set (FIG. 1), focus on protecting each individual piece of jewelry stored within a grouping of multiple pieces of jewelry from dust, abrasion, tangling or any other possible damage from objects within storage. 'Preventable damage intervention' when jewelry is not in use is a twofold process of this invention combination use of the jewelry Display Board and protective cuffed sleeve. First the display board secures a single piece of jewelry for viewing with security bands in a display position (FIG. 5) and second, the display board is enclosed in the protective cuffed sleeve (FIG. 10) which has a cuff that flips over the sleeve opening to provide a secure closure and a lower front edge cuff that holds the Identification Card and/or photo of the stored jewelry enabling identification without visibility and without disheveling the storage of other stored items (FIG. 9).

The Display Board and Cuffed Sleeve is manufactured in a range of ready made sizes and materials to include special order size and material options, both allow consumers to customize their unique storage needs. These customizable options insure this invention can revolutionize consumers existing storage solutions and/or create and organize new and more effective solutions for the modern consumers and post 911 travelers.

Each piece of jewelry is secured to an appropriately sized display board by inserting each end of a necklace or bracelet through the clasp loops (FIG. 4A) and closing the jewelry clasp in the same manner as worn around the neck or wrist (FIG. 5). The bridge (FIG. 4A) between the clasp loops simulates the neck and/or wrist, separating the jewelry sides and enabling the jewelry to hang in an abbreviated display of its style for viewing and in storage. Earrings are securely hung from the Center Bridge open slots and/or secured to the piercing surface above the clasp loops (FIG. 7). For protection in storage, the jewelry is secured to the display board with attached secure bands wrapping around the jewelry and the board and fasten securely in place onto the board by Velcro or the like. Customize special orders closure options include hook & eye, snaps, tying as with ribbons and/or fixed in place secure bands of elastic. Optional closures used for the display board secure bands provides customizable preferences for individual consumers unique motor skills and/or visual preferences for the style of jewelry being attached with the secure bands. Regardless of preference each style of secure bands provide the same degree of security and protection and any type of metal or hard material closure is attached to the back of the display board to insure no possible harmful contact with the jewelry.

The Display Board is padded and has specific protective attached features required to secure specific types of jewelry to the Display Board for display and/or storage. These specific attaching features are creatively and aesthetically stitched to every board to allow the economical and interchangeable use of this invention for all types of jewelry. Thus, the recommended size selection criteria for this invention is simply the appropriate length and width (longer or wider) of the Display Board. The board's width selection is based on the style of jewelry; earrings, broaches, pins, rings, and/or single strand jewelry should use a three-inch or wider display board and bulky stones or multiple strands jewelry should use a four-and-one-half inch or wider Display Board. The Display Board length is based on the jewelry's actual length except for bracelets and necklaces for which the display board length is half the length of the necklace or bracelet (example: 4" L earrings and a 8" L bracelet both use a four inch or longer display board and a 24" L necklace would use a 12" L or longer Display Board). The Display Board's Protective Cuffed Sleeve is constructed 1½-2½-inches wider and one-inch longer than its coordinating board. This invention manufactured package label and product label will indicate product size and recommended range of jewelry sizes and styles to use for the full protective benefits of this invention. The Display Board with the secured and appropriate size jewelry is inserted into the Protective Sleeve with the jewelry facing up to complete the twofold packaging sequence and the twofold functional (display and travel-ready) storage and protection of each individual piece of jewelry to accomplish and maintain a protective and effortless organized storage of each piece of jewelry in storage together.

The Protective Cuffed Jewelry Sleeve has a front/top-side layer of padding, two functional cuffs (FIG. 2) and a carrying or hanging handle (FIG. 3). The Sleeve top cuff flips over the sleeve opening to securely close the sleeve (FIGS. 11 and 3B), concealing the jewelry from dust exposure and a prevention measure to keep the display board safely locked inside the protective sleeve, maintaining the combined sandwich effect of padded protection for the attached jewelry; the jewelry is stored between the sleeve and board protective padding.

This invention protective Cuffed Sleeve has a concealed handle (FIG. 2), for hand carrying or hanging, which is revealed for use when the top cuff is flipped over to close the sleeve opening. The attached handle enables this invention to be hung from existing or new hanging mechanism, organize, protect and eliminate the layers of exposed jewelry hung atop of each other in a cluttered and damaging environment (FIG. 3). The handle is used to hang this invention in identifiable and protective layers of unexposed single pieces of jewelry. Because of the various choices of the ready made and special-order manufacturing, this invention can be fabric and/or color coordinated as a room décor accessory when the jewelry storage is visible from wall/door hanging mechanism, shelving or open-style creative and/or decorative storage containers.

This invention protective sleeve bottom edge attached cuff to the sleeve front-side holds the enclosed stored jewelry identification card and/or photo image for easy and readily identification without having to remove the jewelry while effectively eliminating constant disheveling, clutter and reorganizing a mass storage of exposed jewelry. The manufacturing of even numbered length of this invention for ready-made retail allows the individual consumers to customize their order of stacking or hanging sequence in storage. Stacking or hanging this invention in two or more inches intervals allow the Identification marker to always be visible for each piece of stored jewelry at a instant glance, example: (4½×4, 4½×6, 4½×12, 4½×16), when this invention is stacked with top edges even. Stacking this invention all in one length does not hinder identification. Because the identification cuff is attached at the bottom of the sleeve, slightly lifting the bottom edge of the sleeve on top reveals the Identification of the jewelry below without displacing or disorganizing the storage. The sleeve handle can be used in the easy removal of the identified stored jewelry needed.

This invention simplicity in use is as unique and ageless as it is a timely invention for updating jewelry storage relevant to the needs of today's consumers; efficient use of time and space without sacrificing maximum protection of investment and pride in jewelry ownership. This invention's revolutionary storage application for protecting jewelry is limitless because its design is interchangeable, customizable and manufactured in various sizes to accommodate every style and length of jewelry to be secured and protected in storage while packed ready for travel and displayed by its full length and width in an unexposed storage, eliminating damages from air exposure, exposed jewelry and other objects; effectively eliminating abrasion, dust, folding, bunching and tangling from the use of undersized boxes, drop-in bags and/or pouches, exposed multiple piece storage products and storage containers, furniture and hanging mechanisms prone to creating clutter and damaging storage environments.

This invention Single-Piece Protective Cuffed Sleeve and Display Board set is lined and padded for storing and protecting jewelry displayed and secured to the covered and padded surface of the rigid display board. The set creates a sandwich effect of protection. The display board with attached jewelry is secured inside the protective sleeve when the cap cuff is flipped over the sleeve opening for a secure closure. The flip-cuff-cap can be stitched to flip from the sleeve front-to-back or back-to-front to create a secure cuff-capped closure in addition to revealing a hidden handle.

This invention is made of sewing materials of assorted colors and patterns in a range of standard whole and half sizes. The protective Cuffed Sleeve is manufactured 3 to 6 inches wide by 4 to 26 inches long and the Display Board is manufactured 2 to 4½ inches wide by 4 to 24 inches long; the sleeve is finished one or more inches longer and 1 or more inches wider than the display board. This invention has a special order manufacturing size option for consumers customized unique size requirements.

The Cuffed Sleeve and its lining are made with two identical rectangle fabric panels cut double the finished width plus two inches and the finished length plus two inches with center markings to indicate the front and back. The sleeve closes with a flip over cuff made with a cut of material 3 to 5 inches long by the width of the sleeve front or back and folded in half with the wrong sides together. The Sleeve handle is a ½ inch wide ribbon or a ½" wide finished band made from same sleeve material. The finished handle is cut 1-inch longer than the flip over cuff width. The handle is stitched to the right side of the sleeve front or back, at the center of the front and back panel and at the side raw edge. The folded flip over cuff is placed over the handle with top and side raw edges even and at front and back panel center; keeping the handle free of top edges, the flip over cuff is stitched to the back or front top edge, panel center, and the raw side edge. The sleeve identification cuff fabric, cut 3-4 inches long by the width of the sleeve bottom front, is folded in half lengthwise; The cuff bottom raw edge is stitched to the sleeve bottom front edge, the side edges are stitched to the front and back panel center and to the back side raw edge to form the sleeve 1½-2-inch deep Identification cuff. A protective layer of ¼ to ½ inch batting or foam is attached to the wrong side of the front. The cuffed sleeve is fully lined using an identical measured cut front and back panel as the sleeve front and back panel. The lining front and back panel is cut from the sleeve material or a coordinating material. With right sides together the sleeve lining front and back panel is stitched to the top edge of the sleeve front and back panel. The sleeve and lining are open out and folded in half lengthwise with right sides together and stitched the length of the raw side edge, folded side edge and the cuff sleeve bottom edge. The sleeve is turned right side out with the lining extending from top edge of the cuff sleeve. The lining bottom front and back edges are stitched together with wrong sides together. The lining is inserted inside the cuff sleeve completing the assembly of the protective cuffed sleeve. The attached flip over cuff will flip over the finished sleeve opening creating a cuff-cap closure revealing the handle used for easy slide removal of the filled sleeve from stacked storage, for carrying or for hanging. The front identification cuff holds a readily identifiable ID card or photo extending above the cuff. The cuffed sleeves can be stacked in sequence of even number intervals of two or more inches in lengths or stacked of same lengths; staggered lengths stacking allows each ID card to always be visible.

The Display Board insert is a canvas, foam, mat or wood-product board inserted into a snug fitting padded sleeve-cover with attached like-material clasp loops and secure bands to hold the jewelry in place, preventing damaging movement in storage or when traveling. The board material panel for the cover is cut double the width of the board plus 2 inches and the length is cut the length of the board plus 3-inches. Construction of the panel can be sewn with two side seams or it can be constructed with a single center-back-seam. For the single center-back seam, the display board sleeve-cover material panel is marked at center to determine the center front of the board cover sleeve. The raw edges of the material panel are each placed ½-inch overlap of the center-front marking to mark sides of the board sleeve-cover. The bottom edge of the board sleeve cover panel has ½ inch pressed to the wrong side of the fabric and edge-stitched together after inserting the board. The clasp loops and secure bands are cut from a finished band-strip of like-material made from a strip of fabric cut 2-3 inches wide by a length determined by the number of secure bands needed plus the length of the clasp loops band needed plus 3 inches. The secure bands are cut double the board width plus 2-inches attached to one side raw edge with the first secure band attached two inches below the clasp loops and at 3-4 inch intervals between each secure bands, ending with a two to three inch wide secure band cut the width of the cover-sleeve panel and stitched in-place at the board's side and bottom raw edges (a pocket-like attachment). The band for the clasp loops is cut the width of the sleeve fabric panel plus 1 inch. To form the clasp band strip, the fabric strip side edges are pressed to the center of the strip and the folded edges are pressed together and edged-stitched or the strip can be stitched with right-side edges together, turned and pressed. The clasp loop band is placed 2 inches below the top edge on the right side of the fabric front and back panel. The clasp loop band center and raw edges are stitched to the raw edges and at the center of the board cover-panel with the one-inch excess clasp band length pinned to the cover-sleeve front. The center of the front clasp band is stitched to the sleeve center front marking. The clasp band is stitched flat at center by a line of stitching ½ to 1-inch from both sides of the center front, forming a left and right clasp loop with a center bridge to separate the two clasp loops. The lines of stitching on each side of the center-stitched line of the clasp loop create two narrow open slots for use in inserting earrings wire for hanging earrings for display. The three lines of stitching form the bridge for separating the sides of jewelry. With ½-inch ease for each clasp loop, stitch a straight line of stitching through the clasp strip at cover panel side markings. A layer of padding is attached to the length and width of the board sleeve-cover front. The sleeve-cover raw edges are stitched together forming a center back seam and stitched together at top edges. The sleeve-cover is turned right side out. The board is cut 2-inch shorter than the finished cover and inserted from bottom-up. The bottom edges are edged stitched together to finish the Display Board. The padded top edge above the inserted board is used as a piercing surface to attach jewelry. When using material that cannot be pierce easily or safely, a piercing layer of netting, lace or any coordinating material can be attached over the top two inches of the board cover front side.

The back bottom edge of the Display Board has two optional miscellaneous storage pockets created by the Display Board front stitched in-place bottom edge secure band (FIG. 4B). The upper back side of the Display Board has two hanging loops (FIG. 4D) created by the extended ends of the clasp loop band strip across the sleeve-cover back-side with the raw ends stitched into the back center seam. The hanging loops can be used to hang the display board. Hanging the displayed by two loops insures a consistent balanced hanging display.

The invention claimed is:

1. A cuffed jewelry sleeve and display board set, the jewelry storage system comprising a protective jewelry sleeve and a display board;

the display board comprising a rigid insert disposed inside a sleeve cover, the sleeve cover comprising:

at least one secure band wrapped fully around the sleeve cover, and at least one clasp loop forming at least two open slots with a center bridge formed therebetween; and the rigid insert comprising a rigid panel sized to fit snuggly into the sleeve cover and provide rigidity to the display board; and the cuffed jewelry sleeve forming a sleeve with a single sleeve opening and sized to dispose the display board therein, the cuffed jewelry sleeve comprising a top edge cuff disposed proximal the sleeve opening, and the top edge cuff comprising an invertible cuff configured to flip over the sleeve opening of the cuffed jewelry sleeve and cover the sleeve opening of the cuffed jewelry sleeve.

2. The cuffed jewelry sleeve and display board set of claim 1, wherein the sleeve cover comprises at least three secure bands.

3. The cuffed jewelry sleeve and display board set of claim 1, wherein the at least one securing band is affixed to the sleeve cover at only one end and comprises a closure to reversibly affix an opposite end of the at least one secure band to the sleeve cover.

4. The cuffed jewelry sleeve and display board set of claim 3, wherein the closure of the at least one secure band is a hook and loop fastener, a snap, a ribbon configured for tying, or a hook and eye closure.

5. The cuffed jewelry sleeve and display board set of claim 1, wherein the at least one secure band is fixed in place.

6. The cuffed jewelry sleeve and display board set of claim 1, wherein the at least one secure band comprises elastic to allow reversible stretching of the at least one secure band.

7. The cuffed jewelry sleeve and display board set of claim 1, wherein the at least one secure band is fixed in place and comprises elastic to allow reversible stretching of the at least one secure band.

8. The cuffed jewelry sleeve and display board set of claim 1, wherein the sleeve cover extends beyond the rigid insert to form a piercing pillow top configured to allow perforation therethrough for securing of jewelry comprising a sharp stud or pin thereto.

9. The cuffed jewelry sleeve and display board set of claim 1, wherein the cuffed jewelry sleeve further comprises an identification pocket configured to hold an identification marker of the contents of the cuffed jewelry sleeve and display board set.

10. The cuffed jewelry sleeve and display board set claim 1, wherein the sleeve cover further comprises a storage pocket formed from extended ends of the secure band positioned distal the sleeve opening.

11. The cuffed jewelry sleeve and display board set of claim 1, wherein the sleeve cover further comprises at least one hanging loop formed from extended ends of the clasp loop wrapped around the sleeve cover.

12. The cuffed jewelry sleeve and display board set of claim 1, wherein the cuffed jewelry sleeve further comprises a handle revealed when the top edge cuff is flipped over the sleeve opening of the cuffed jewelry sleeve to cover the sleeve opening of the protective jewelry sleeve.

13. The cuffed jewelry sleeve and display board set of claim 1, wherein the cuffed jewelry sleeve comprises a sleeve lining on an interior surface of the cuffed jewelry sleeve.

14. The cuffed jewelry sleeve and display board set of claim 1, wherein the rigid insert comprises wood.

15. The cuffed jewelry sleeve and display board set of claim 1, wherein the rigid insert comprises foam.

16. The cuffed jewelry sleeve and display board set of claim 1, wherein the sleeve cover of the display board comprises natural fibers.

17. The cuffed jewelry sleeve and display board set of claim 1, wherein the cuffed jewelry sleeve comprises natural fibers.

18. The cuffed jewelry sleeve and display board set of claim 1, wherein the display board is 2 to 4.5 inches in width and 4 to 24 inches in length.

19. The cuffed jewelry sleeve and display board set of claim 1, wherein the cuffed jewelry sleeve is 3 to 6 inches in width and 4 to 26 inches in length.

* * * * *